United States Patent [19]

Audeh et al.

[11] Patent Number: 4,568,446

[45] Date of Patent: Feb. 4, 1986

[54] PROCESS FOR TREATING MODIFIED OIL SHALE TO RECOVER SHALE OIL

[75] Inventors: Costandi A. Audeh, Princeton, N.J.; Joseph J. Dickert, Jr., Yardley, Pa.

[73] Assignee: Mobil Oil Corporation, New York, N.Y.

[21] Appl. No.: 673,627

[22] Filed: Nov. 21, 1984

[51] Int. Cl.[4] ..... C10G 1/04

[52] U.S. Cl. ..... 208/11 LE; 208/8 LE

[58] Field of Search ..... 208/11 LE, 8 LE

[56] References Cited

U.S. PATENT DOCUMENTS

| | | | |
|---|---|---|---|
| 3,070,541 | 12/1962 | Price | 208/11 LE |
| 3,353,049 | 1/1971 | Savage et al. | 208/11 LE |
| 3,362,473 | 1/1968 | Foster | 166/273 |
| 4,067,796 | 1/1978 | Alford et al. | 208/11 LE |
| 4,068,716 | 1/1978 | Allen | 166/272 |
| 4,071,433 | 1/1978 | Hanson | 208/11 LE |
| 4,105,570 | 8/1978 | Stournas et al. | 166/273 |
| 4,238,315 | 12/1980 | Patzer, II | 208/11 LE |
| 4,291,765 | 9/1981 | Gilchrist et al. | 166/273 |
| 4,325,803 | 4/1982 | Green et al. | 208/11 LE |
| 4,457,827 | 7/1984 | Chung et al. | 208/11 LE |
| 4,512,872 | 4/1985 | Chung et al. | 208/11 LE |

*Primary Examiner*—D. E. Gantz
*Assistant Examiner*—A. Pal
*Attorney, Agent, or Firm*—Alexander J. McKillop; Michael G. Gilman; Charles A. Malone

[57] ABSTRACT

A method for converting hydrocarbonaceous materials such as oil shale, tar sands and other similar materials into hydrocarbonaceous fluids by use of a liquid hydrogen donor wherein the reaction is conducted in a substantially air free environment and the resultant modified organic content on said shale is recovered without the use of a hydrocarbonaceous solvent.

12 Claims, 1 Drawing Figure

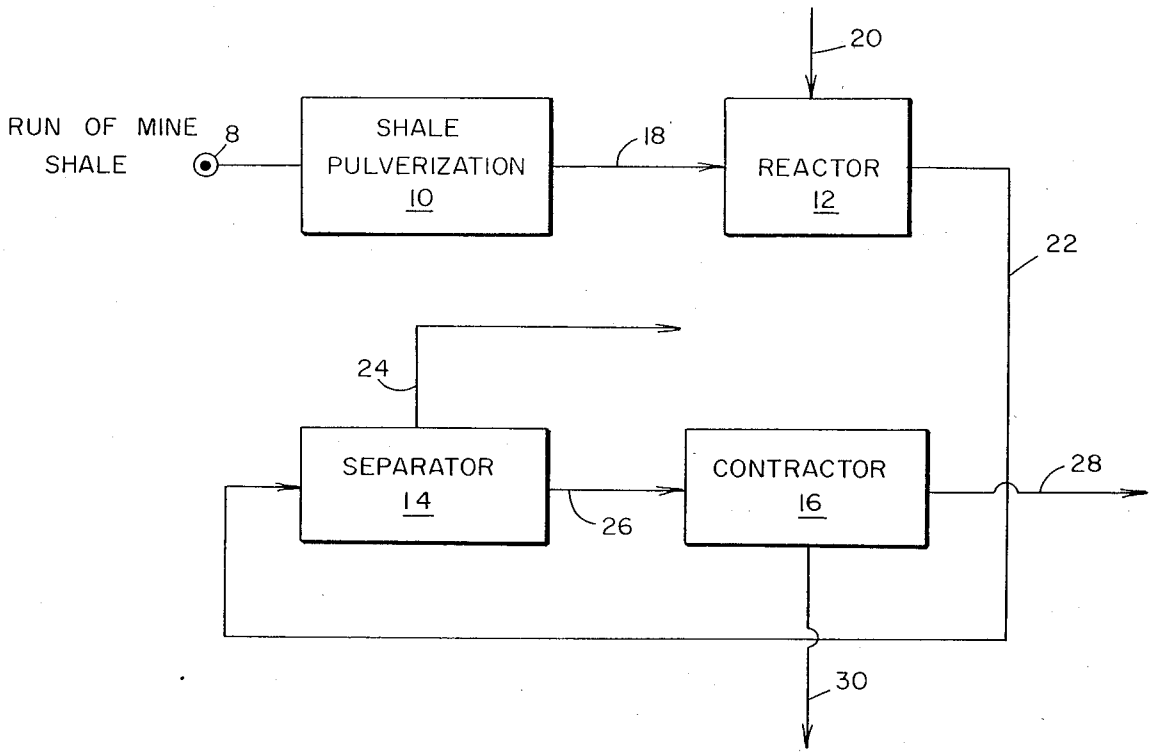
RUN OF MINE SHALE
8
SHALE PULVERIZATION 10
18
REACTOR 12
20
22
24
SEPARATOR 14
26
CONTRACTOR 16
28
30

PROCESS FOR TREATING MODIFIED OIL SHALE TO RECOVER SHALE OIL

FIELD OF INVENTION

This invention is directed to a method for processing oil shale treated with a hydrogen donor solvent which treatment results in a modified oil shale wherein an aqueous fluid is used to recover the hydrocarbonaceous material.

BACKGROUND OF INVENTION

Oil shales, particularly the Devonian-like shales of the Eastern United States contain organic carbon equal in amount to that contained in the Western shale of the Green River formation. However, upon retorting by the usual processes, Eastern shales yield smaller amounts of oil or hydrocarbonaceous material than the Western shales.

Several procedures have been proposed to enhance the yield of oil from Eastern shales. Previously known technologies relating to the recovery of organic material from rock, such as kerogen from oil shale, rely principally upon either thermal means or the use of molecular hydrogen and treat the rock in a substantially dry state, i.e., in the absence of any significant amount of liquid. See, for example, DT-OS No. 2,806,806 to Kraftwerk Union AG and The IGT Hytort Process for Hydrogen Retorting of Devonian Oil shales by S. A. Weil et al., a paper dated Nov. 14, 1978 and presented at The Chattanooga Shale Conference. Such processes require the system transport of essentially dry rock and/or require the extensive use of inherently dangerous hydrogen gas.

Green et al., in U.S. Pat. No. 4,325,803, issued Apr. 20, 1982 disclosed a method for removing organic material from oil bearing rock. According to the invention, rock containing organic material was contacted with a hydrogen transfer agent which was liquid at standard conditions by forming a slurry of the rock to be treated and a liquid comprising such a hydrogen transfer agent. In a preferred embodiment of the invention, rock containing the organic material to be separated, such as oil shale, was pulverized, preheated via contacting with hot recycle vapors and slurried with a liquid comprising a hydrogen transfer agent. The slurry was then reacted at an elevated temperature and pressure and the product of the reaction flashed.

Patzer in U.S. Pat. No. 4,238,315 issued Dec. 9, 1980 disclosed another process for obtaining oil from oil shale. In his process oil was recovered from oil shale and a solvent using a temperature in the range of about 385° to about 440° C. and a pressure in the range of about 250 to about 2,000 pounds per square inch gauge (about 1.72 MPa to about 13.8 MPa) for a period of about 20 minutes to about two hours and thereafter recovering the resulting oil.

It has been observed when a H-donor solvent is used to modify an oil shale, a material is formed that is soluble in a variety of solvents. Using the prior art methods required the use of organic solvents to remove the H-donor modified organic content ("MOC") from treated shale. These solvents were often expensive and sometimes potentially hazardous to the environment.

Therefore, what is needed in a H-donor solvent process, is a method to eliminate the organic solvent extraction step after the shale has been contacted with H-donor solvent.

SUMMARY OF THE INVENTION

This invention discloses a method for converting hydrocarbonaceous materials such as oil shale, tar sand, and similar materials into fluids via use of a liquid hydrogen donor. To accomplish this, oil shale or tar sand is reacted in the presence of a liquid hydrogen donor under conditions suitable for fluid conversion within a substantially air free environment. Afterwards, the resultant fluids are separated from the oil shale, which oil shale contains a hydrogen donor modified organic content. The resultant hydrogen donor modified organic content is recovered from the oil shale by use of a physical separation process.

It is therefore an object of this invention to eliminate oxidation of the H-donor solvent and avoid a resultant increase in molecular weight of said solvent.

It is a further object of this invention to avoid using expensive organic solvents to recover the hydrogen donor modified organic content.

It is a yet further object of this invention to provide for a more efficient conversion and easier recovery of the H-donor modified organic content contained on oil shale.

BRIEF DESCRIPTION OF THE DRAWING

The drawing is a block flow diagram of an embodiment of this invention.

BRIEF DESCRIPTION OF THE PREFERRED EMBODIMENT

In a preferred embodiment of the invention, rock containing the organic material such as oil shale, can be separated. To accomplish this, the rock is pulverized, preheated by contacting with hot recycle vapors, and slurried with a liquid comprising a hydrogen transfer agent. The slurry is reacted at an elevated temperature and pressure and the product of the reaction is flashed. A method which can be used for making a slurry with use of the hydrogen transfer agent is described in U.S. Pat. No. 4,325,803, issued Apr. 20, 1982 to Green, et al. This patent is hereby incorporated by reference.

Preferred applications of the process of this invention include the separation and hydrogenation of kerogen and oil shale or tar sands. Although it is known that molecular hydrogen will react with kerogen in shale to enhance the yield of shale oil and hydrogen carbon gases obtained by retorting, the resultant reactions are comparatively nonselective, in that a wide range of hydrocarbon products from methane to higher molecular weight oils are formed. When hydrogenation agents according to the present invention are employed in the described method, however, selective extraction and hydrogenation of kerogen occur, such that high yields of liquid hydrocarbons boiling between about 40° C. and about 500° C., especially between 40° C. and 250° C., are obtained and yields of methane and other light hydrocarbon gases, which contain significantly more hydrogen per unit of carbon than the higher boiling hydrocarbons, are markedly reduced.

Suitable starting materials for use in the process of the invention inclued run-of-mine oil shales, comprising sedimentary rock and appreciable quantities of organic materials, such as the Devonian marine shales of the eastern United States and the Eocene lacustrine shales of the western United States. The invention is also useful for sand grains containing water and bitumen.

Suitable hydrogen transfer agents include distillates boiling in the range of from about 175° C. to about 325° C. and containing at least about 25 percent, preferably at least about 35 percent, hydrogen donating compounds, including hydroaromatics and multiphenols such as tetralin, alkylhydronaphthalenes, dihydronaphthalene, methyltetralin, alkylhydrophenanthrenes, naphthahydroquione and the like.

According to a preferred embodiment illustrated in the block flow diagram of the drawing, run-of-mine shale 8 is first pulverized and placed into a pulverization unit 10. After pulverization, the shale is removed from pulverization unit 10 into reactor 12 through line 18. Upon reaching reactor 12, a hydrogen donor solvent is mixed with the shale. The reactor 12 is made substantially air and oxygen free by use of an inert gas. This inert gas comes into reactor 12 via line 20. Inert gas is utilized to remove air or oxygen and making the atmosphere in the reactor substantially air free. Other inert gases which can be utilized include carbon monoxide, carbon dioxide, nitrogen, flue gas and argon. As is known to those skilled in the art, other commercially available inert gases will also work.

After flushing with a suitable inert gas, the reactor is heated to a temperature of from about 175° to about 325° C. and operated for a time sufficient to convert the oil shale into liquids and gases. After converting the oil shale to liquids and gases, the shale remaining will contain a modified organic content.

Examples of other hydrogen donor organic solvents which can work in the method of this invention are described in U.S. Pat. No. 4,238,315, issued to Patzer on Dec. 9, 1982. This patent is hereby incorporated by reference.

The mixture of oil shale and solvent to be treated herein can be obtained in any convenient manner, for example by adding oil shale to solvent or solvent to oil shale or by bringing the two simultaneously in contact with each other. A solvent to shale weight/ratio (w/w) of at least about 1.25:1, preferably at least about 1.5:1 must be employed in order to obtain maximum oil yields. The upper limit of the solvent to shale ratio is not critical and is determined by economics of operation and capability of equipment, but can be, for example no greater than about 4:1, preferably no greater than about 2:1. The mixture is then brought to a temperature of about 385° to about 440° C., preferably about 400° to about 420° C., in a time period of about 2 to about 10 minutes, preferably about 3 to about 5 minutes. Such heating can be carried out in any suitable manner, for example, by bringing together oil shale and solvent, with the solvent being at a sufficiently high temperature to obtain the desired temperature level, or by external means. It is preferred that the hot solvent be brought into contact with shale which is at a lower temperature.

Once the mixture of oil shale and solvent defined above is heated to the desired temperature level within the defined time period, the mixture is maintained at a temperature of from about 385° to about 440° C., preferably from about 400° to about 420° C. and a pressure of from about 250 to about 2,000 lbs. per square inch gauge (about 1.72 to about 13.8 MPa) preferably from about 500 to about 1200 lbs. per square inch gauge (about 3.45 to about 8.27 MPa) for a period of from about 20 to about 2 hours, preferably from about 50 minutes to about 80 minutes. At the end of such time the resulting oil shale containing a modified organic content ("MOC"), is recovered from the spent shale in any suitable manner.

For example, the reactor contents can be brought to ambient temperature and ambient pressure. Afterwards the shale oil, including the solvent, can be separated from the spent shale by conventional means, for example, by filtration, settling or centrifuging. The oil and solvent mixture can then be sent to a fractionator to effect separation and the solvent can be recycled for further utilization in the process. The process defined herein results in the heavy oil having a boiling point of about 220° C. at ambient pressure, with only trace amounts of products boiling below 220° C.

The reactor 12 contents are removed therefrom via line 22 and flow into separator 14. As is shown in the drawing, the shale oil and solvent are removed from separator 14 by a line 24. The shale containing the modified organic content is removed from separator 14 by line 26 and is fed into contactor 16. Part of the modified oil content on the shale can be recovered by drainage, decantation and/or other physical separation processes. The remaining fraction of the modified oil content, intimately associated with the inorganic materials, require further treatment for recovery. This is required since the modified oil content is in a matrix which can now be treated for recovering the modified oil content in the inorganic matrix, as for example by a process of chemical water flooding.

A chemical waterflooding technique which can work in the method of this invention is described in U.S. Pat. No. 4,457,827 issued July 3, 1984 to Chung. This patent is hereby incorporated by reference. In contactor 16, chemical waterflood fluids that are well known in the art are contacted with the shale containing the modified organic content. Such chemical waterflooding fluids may contain surfactants and/or mobility control agents such as polymers. For typical disclosures of such fluids, reference is made to W. R. Foster, and "A Low-Tension Waterflooding Process," Journal of Petroleum Technology, Volume 25, Feb. 19, 1973, pp. 205–210 and to U.S. Pat. Nos. 3,308,883; 3,362,473; 4,105,570 and 4,120,801. These patents are hereby incorporated by reference. Generally, use is contemplated of low salinity petroleum sulfonate base formulations, as well as brine-tolerant formulations, in cases where multivalent cations and salt content of a matrix are high. The aqueous chemical waterflooding fluid may be, e.g., in the form of a solution or a microemulsion containing a small amount (e.g., from about 3 to about 20% by weight) of an oil additive. After contacting the shale with the surfactant for a time sufficient to remove the modified organic content therefrom, the modified organic content floats to the top of the fluid and is removed from the contactor 16 via line 28. Further separation occurs and the modified organic content alone is recovered by itself. The shale from which the modified organic content has been removed is removed from contactor 16 via line 30.

In making certain that the atmosphere in reactor 12 is substantially oxygen or air free, the hydrogen donor solvent may be purged with an inert gas. Similarly, the shale after being pulverized may also be purged with an inert gas. As disclosed above, it is also permissable to introduce the inert gas into the reactor after mixing the hydrogen donor solvent, and pulverized shale together in the reactor.

Many other variations and modifications of this invention, as previously set forth, may be made without departing from the spirit and scope of this invention as those skilled in the art readily understand. Such variations and modifications are considered part of this invention and within the purview and scope of the appended claims.

What is claimed is:

1. In a method for producing hydrocarbonaceous fluids from oil shale where said oil shale is hydrotreated under hydrotreating conditions in a reactor in the presence of a hydrogen donor solvent, the improvement comprising:

(a) conducting said hydrotreating reaction in a reactor in a substantially air free atmosphere which produces hydrocarbonaceous fluids and an oil shale containing a hydrogen donor modified organic content;

(b) separating said hydrocarbonaceous fluids, including said hydrogen donor, from said oil shale containing said hydrogen donor modified organic content;

(c) contacting said oil shale with an aqueous chemical waterflooding fluid which removes the modified organic content from said shale by floatation; and (d) recovering said modified organic content from said aqueous waterflooding fluid.

2. The method as recited in claim 1 where in step (a) the atmosphere during said reaction is made substantially air free by the use of an inert gas.

3. The method as recited in claim 1 where in step (a) the atmosphere during the reaction is made substantially air free by the use of an inert gas selected from a member of the group consisting of nitrogen, carbon dioxide, carbon monoxide, argon, and mixtures thereof.

4. The method as recited in claim 1 where in step (c) said hydrogen donor modified organic content is removed from said shale by the use of a chemical waterflooding fluid which comprises a surfactant.

5. The method as recited in claim 1 where in step (c) the modified organic content is recovered from said shale by the use of a chemical waterflooding fluid which comprises a surfactant which surfactant comprises a petroleum sulfonate.

6. The method as recited in claim 1 where in step (c) said hydrogen donor modified organic content is recovered from said shale by the use of a chemical waterflooding fluid which comprises a polymer.

7. In a method for producing hydrocarbonaceous fluids from oil shale where said oil shale is hydrotreated under hydrotreating conditions in a reactor in the presence of a hydrogen donor solvent, the improvement comprising:

(a) conducting said hydrotreating reaction within a reactor in a substantially air free atmosphere which produces hydrocarbonaceous fluids and an oil shale containing a hydrogen donor modified organic content;

(b) separating said hydrocarbonaceous fluids, including said hydrogen donor, from said oil shale containing said hydrogen donor modified organic content;

(c) contacting said oil shale with an aqueous chemical waterflooding fluid which removes the modified organic content from said shale by floatation;

(d) recovering said modified organic content from said aqueous waterflooding fluid;

(e) separating said modified organic content from said aqueous surfactant; and (f) mixing said modified organic content with a hydrocarbonaceous solvent which reduces the viscosity of said modified organic content to facilitate transportation thereof.

8. The method as recited in claim 7 where in step (a) the atmosphere during said reaction is made substantially air free by the use of an inert gas.

9. The method as recited in claim 7 where in step (a) the atmosphere during the reaction is made substantially air free by the use of an inert gas selected from a member of the group consisting of nitrogen, carbon dioxide, carbon monoxide, argon, and mixtures thereof.

10. The method as recited in claim 7 where in step (a) said hydrogen donor modified organic content is removed from said shale by the use of a chemical waterflooding fluid which comprises a surfactant.

11. The method as recited in claim 7 where in step (c) the modified organic content is recovered from said shale by the use of a chemical waterflooding fluid which comprises a surfactant which surfactant comprises a petroleum solfonate.

12. The method as recited in claim 7 where in step (c) said hydrogen donor modified organic content is recovered from said shale by the use of a chemical waterflooding fluid which comprises a polymer.

* * * * *